US006341167B1

(12) United States Patent
Okuyama et al.

(10) Patent No.: US 6,341,167 B1
(45) Date of Patent: Jan. 22, 2002

(54) SPEAKER

(75) Inventors: Masatoshi Okuyama; Masahide Sumiyama; Kazurou Okuzawa; Mutsufumi Fujii, all of Mie (JP)

(73) Assignee: Matsushita Electric Industrial Co., Inc., Osaka (JP)

( * ) Notice: Subject to any disclaimer, the term of this patent is extended or adjusted under 35 U.S.C. 154(b) by 0 days.

(21) Appl. No.: 09/485,901

(22) PCT Filed: Jun. 17, 1999

(86) PCT No.: PCT/JP99/03241

§ 371 Date: May 17, 2000

§ 102(e) Date: May 17, 2000

(87) PCT Pub. No.: WO99/66764

PCT Pub. Date: Dec. 23, 1999

(30) Foreign Application Priority Data

Jun. 18, 1998 (JP) ..... 10-71056

(51) Int. Cl.[7] ..... H01R 25/00

(52) U.S. Cl. ..... 381/407; 381/423; 381/430

(58) Field of Search ..... 381/396, 398, 381/407, 412, 421, 423, 430, FOR 153, FOR 159

(56) References Cited

U.S. PATENT DOCUMENTS 5,664,024 A * 9/1997 Furuta et al. ..... 381/412
5,862,242 A * 1/1999 Takewa et al. ..... 381/398

FOREIGN PATENT DOCUMENTS

JP 5-93198 12/1923
JP 7-298389 11/1995

* cited by examiner

*Primary Examiner*—Curtis Kuntz
*Assistant Examiner*—Suhan Ni
(74) *Attorney, Agent, or Firm*—Wenderoth, Lind & Ponack, L.L.P.

(57) ABSTRACT

A speaker comprising a magnetic circuit containing at least a magnetic gap, a frame connected to the magnetic circuit, and an integral unit consisting of a ring shaped voice coil bobbin unit which is wound around with coil to be coupled in the magnetic gap, and a diaphragm unit formed in the shape of an inverse letter "U" disposed on an upper edge of the voice coil bobbin unit. This speaker provides enhanced rigidity, a reduction in production/assembly cost, and an improved sound pressure level.

2 Claims, 6 Drawing Sheets

SPEAKER

BACKGROUND OF THE INVENTION

1. Field of the Invention

The present invention relates to a speaker for use in a television receiver and in various audio/video apparatus.

2. Description of the Prior Art

In most of television receivers, a speaker is located at both sides of a cathode ray tube. Speakers of an oblong profile, such as square, oval, etc. have been used for the application. Recently, an increasing number of cathode ray tubes are assuming the screen dimensions of a laterally expanded aspect ratio. As a result, the speakers are requested to have a narrower profile. The speakers are also requested to be able to reproduce high-quality sound corresponding to an improved picture quality.

A conventional oblong speaker is described next with reference to FIG. 6, FIG. 7 and FIG. 8.

FIG. 6 is an exploded perspective view, FIG. 7 is a perspective view of an integral unit consisting of voice coil bobbin unit and a diaphragm unit, and FIG. 8 is a perspective view of a sheet for the integral unit consisting of the voice coil bobbin and the diaphragm before they are formed into the integral unit.

An integral unit 1 consists of a diaphragm unit 1*a* of an oblong shape having a non-axial symmetry with the major axis and the minor axis for generating the air vibration and a voice coil bobbin unit 1*b*. The periphery of diaphragm unit 1*a* is supported by a frame 3 via an edge 2. A supplement cover 9*a*, 9*b* is adhered to the diaphragm unit at both ends of the major axis, which are the portions of the diaphragm which are not formed.

A truss 8 is provided bridging the inner circumference of voice coil bobbin unit 1*b*, and connected to about the middle of a damper 7 having an approximate shape of a letter "S", so that the voice coil bobbin unit is supported by the frame 3 in a freely vibrating manner.

The frame 3 is provided in the middle hollow part with a plurality of magnetic circuits 6 formed of a yoke 4 and a magnet 5. A coil 1*c* is attached firmly around the voice coil bobbin unit 1*b*, and the coil 1*c* is placed in the gap of magnetic circuit 6. The voice coil bobbin unit 1*b* makes a piston motion in accordance with a drive current supplied to the coil 1*c*. Thus the diaphragm unit 1*a* vibrates to radiate sound waves.

A gasket 3*a* is provided to fix the edge 2 on the frame 3.

The integral unit 1 consisting of the voice coil bobbin and the diaphragm is prepared by first producing the diaphragm unit 1*a* and the voice coil bobbin unit 1*b* out of an oblong sheet 1*d* of hard aluminum, paper, resin film, or the like materials, as shown in FIG. 8, by forming it into the shape of an inverse letter "U", and then winding a magnet wire around it using a winding jig for forming the coil 1*c*. The conventional integral unit 1 consisting of the voice coil bobbin and the diaphragm thus prepared, however, bears with it the drawbacks as described below.

1. The conventional integral unit is provided by forming an oblong sheet into the shape of an inverse letter "U" to produce the voice coil bobbin unit 1*b* and the diaphragm unit 1*a*, and then the coil 1*c* is wound around it. As a result, the voice coil in the semi-circular portions at both ends of the major axis is formed with the coil 1*c* alone. Therefore, the rigidity is not high enough, and the coil 1*c* easily gets loosened.

2. The conventional integral unit 1 consisting of the voice coil bobbin and the diaphragm is provided by forming an oblong sheet into the shape of an inverse letter "U", and winding the coil 1*c* around it, and then a diaphragm supplement cover 9*a*, 9*b* made of paper, resin or other such material that is suitable for manufacturing the diaphragm formed into a semi-spherical shape is attached with adhesives in advance or during the assembly process on the diaphragm at both ends of the major axis, or the places void of the diaphragm. This not only lowers productivity of the manufacturing, but the added weight due to the supplement covers 9*a*, 9*b* and the adhesives deteriorates the level of sound pressure.

SUMMARY OF THE INVENTION

The present invention addresses the above described drawbacks, and aims to provide a speaker that has an improved sound quality and performance at a reduced cost of assembly. A speaker of the present invention comprises a magnetic circuit containing at least the magnetic gap, a frame connected to the magnetic circuit, and an integral unit consisting of a voice coil bobbin unit and a diaphragm unit connected at the periphery of the frame via an edge. The integral unit is formed of a ring shape voice coil bobbin unit which is wound around with coil to be placed in the magnetic gap and a diaphragm unit formed in the shape of an inverse letter "U" which is disposed on the upper edge of the voice coil bobbin unit. Since the voice coil bobbin unit is formed to a ring shape in the above described configuration, the rigidity is enhanced. This prevents an irregular winding of a coil on the voice coil bobbin, and the coil does not get loosened easily.

BRIEF DESCRIPTION OF THE DRAWINGS

Referring now to the drawings, where like numerals represent like parts in several views.

DETAILED DESCRIPTION OF THE INVENTION

First Embodiment

Figure 2:
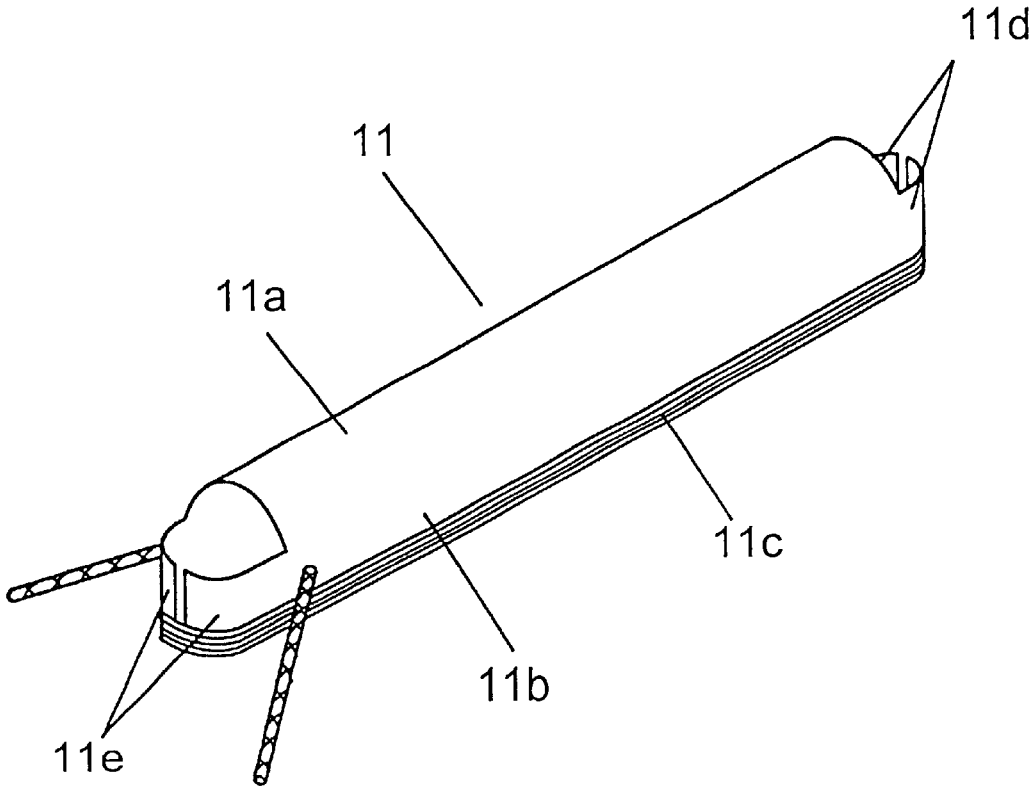
FIG. 2 is a perspective view of an integral unit consisting of a voice coil bobbin unit and a diaphragm unit, the integral unit being a key portion of the speaker.
Figure 3:
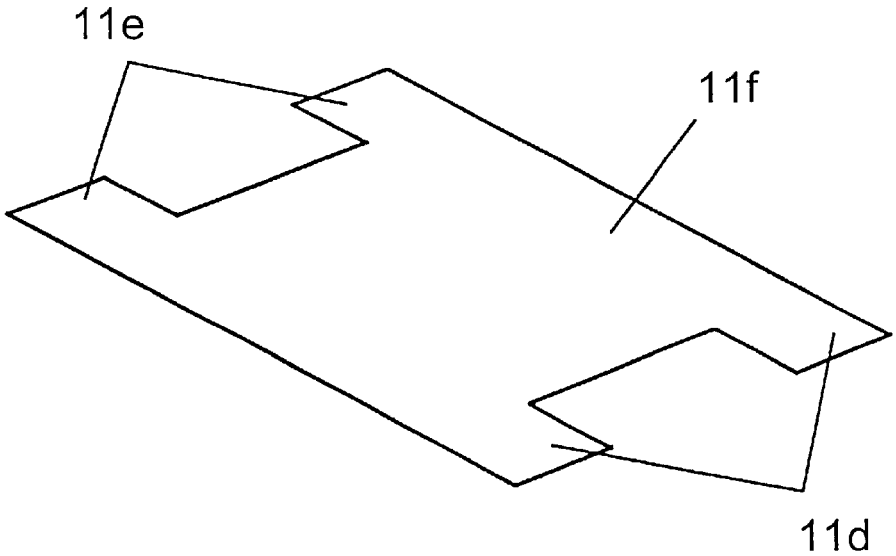
FIG. 3 is a perspective view of the integral unit consisting of a voice coil bobbin unit and a diaphragm unit in the state of a sheet before it is fabricated to make the integral unit.

A speaker in accordance with an exemplary embodiment of the present invention is described in the following with reference to FIG. 1 through FIG. 3.

Those portions in the drawings that are based on the same technology as in the conventional speaker are represented with the same symbols, and detailed descriptions of these portions are omitted here.

Figure 1:
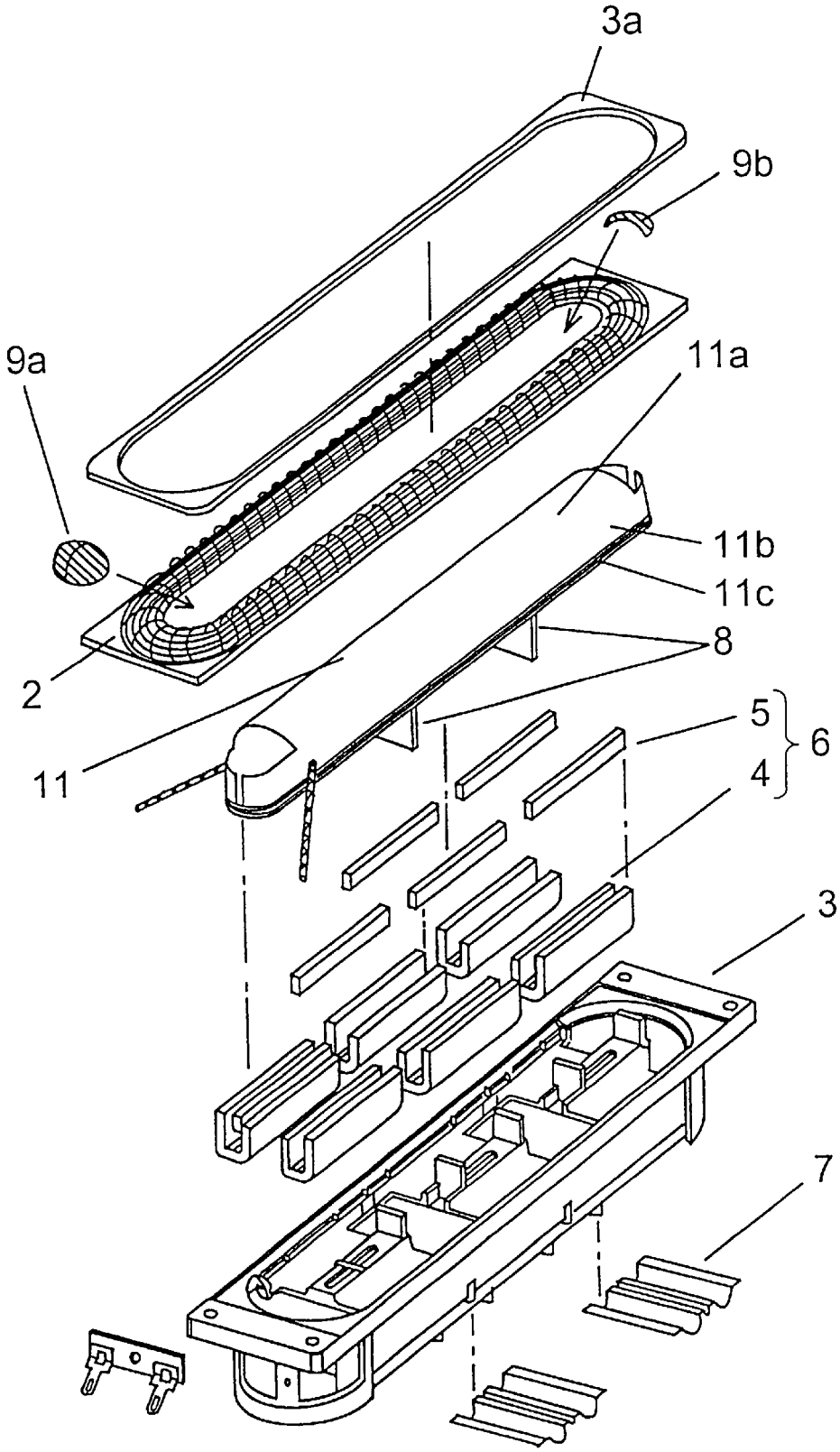
FIG. 1 is an exploded perspective view of a speaker in accordance with an exemplary embodiment of the present invention.

As shown in FIG. 1, an integral unit 11 consists of a voice coil bobbin unit and a diaphragm unit. Generally the diaphragm unit 11*a* is equal to a conventional diaphragm unit la, the voice coil bobbin unit 11*b* is equal to a conventional voice coil bobbin unit 1*b*, and the coil 11*c* is equal to conventional coil 1*c*. As shown in FIG. 2 and FIG. 3, the integral unit 11 consisting of the voice coil bobbin unit and the diaphragm unit differs from the conventional counterpart in that the integral unit 11 of the present invention is made out of a sheet 11 if, which was provided through a punching of a sheet into the shape of a letter "H" having a pair of extensions 11*d*, 11*e* from both sides, formed into the shape of an inverse letter "U" by pressing or the like means, and then the pair of extensions 11*d*, 11*e* locating at both ends of the voice coil bobbin unit are adhered together at their respective ends to have the voice coil bobbin unit 11*b* completed into a ring form.

Thus in the integral unit 11 consisting of the voice coil bobbin unit and the diaphragm unit, the voice coil bobbin unit 11*b* is formed in a complete ring shape with the semicircle portion at both ends of the major axis of the ring also accompanied by the voice coil bobbin unit 11*b* member. In this way, rigidity of the voice coil bobbin unit 11*b* has been enhanced, and the coil 11*c* wound thereon has a sufficient stability so as to prevent from going loose easily, and the quality is stabilized.

Second Embodiment

Figure 4:
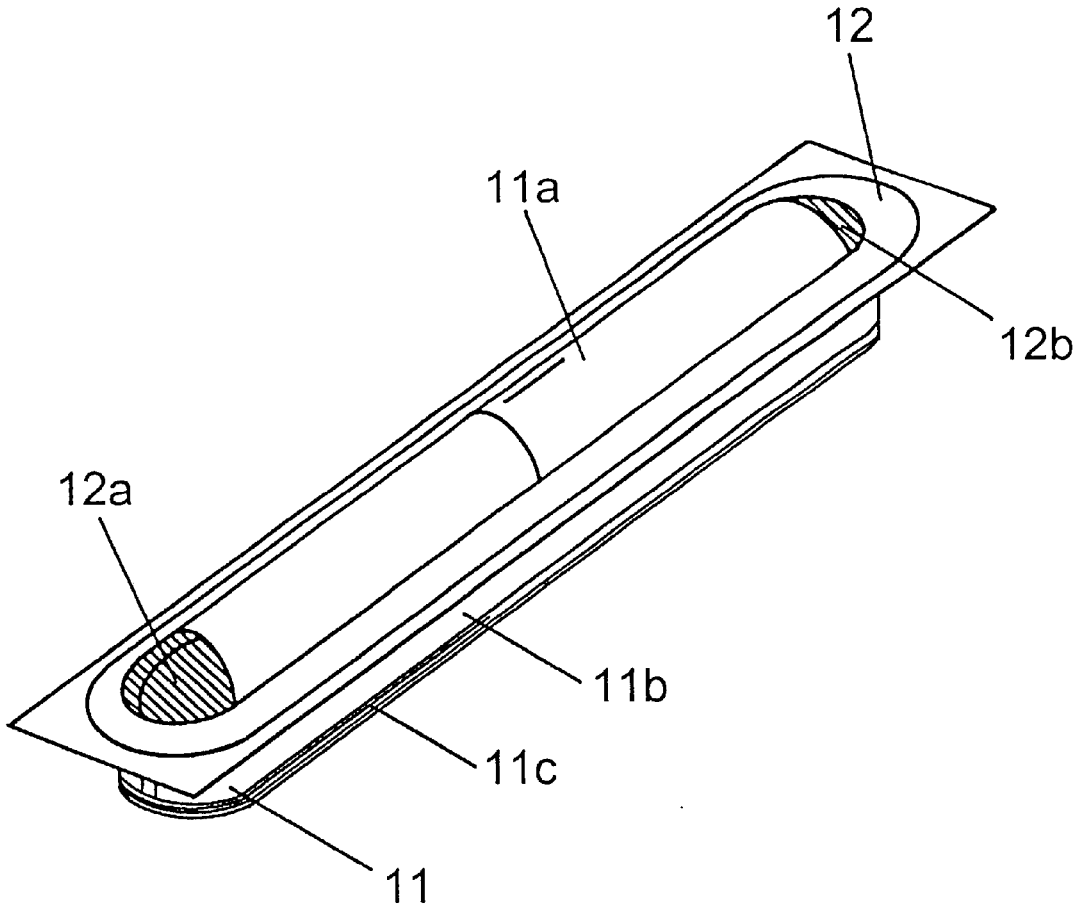
FIG. 4 is a perspective view of the integral unit in another exemplary speaker, shown in a state being connected with an edge.
Figure 5:
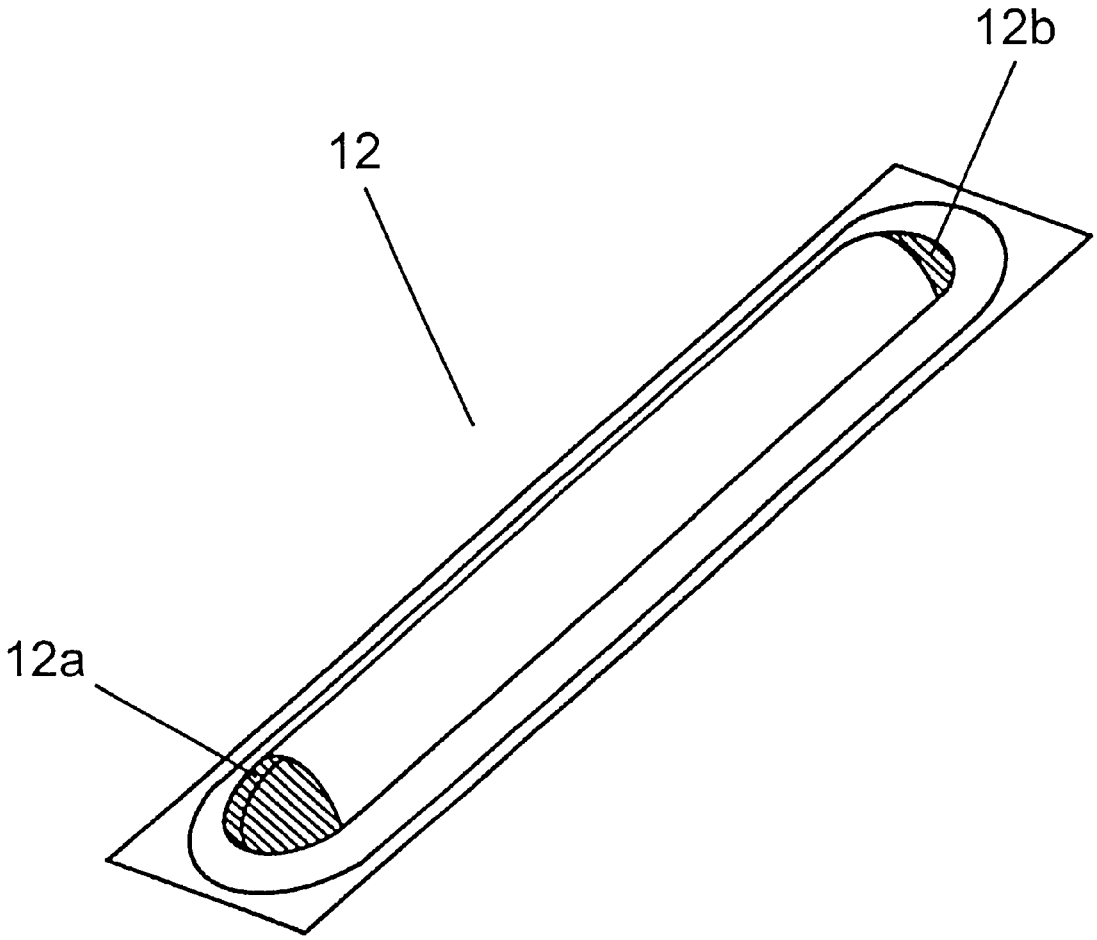
FIG. 5 is a perspective view of the edge, the edge being a key portion of the speaker.
Figure 6:
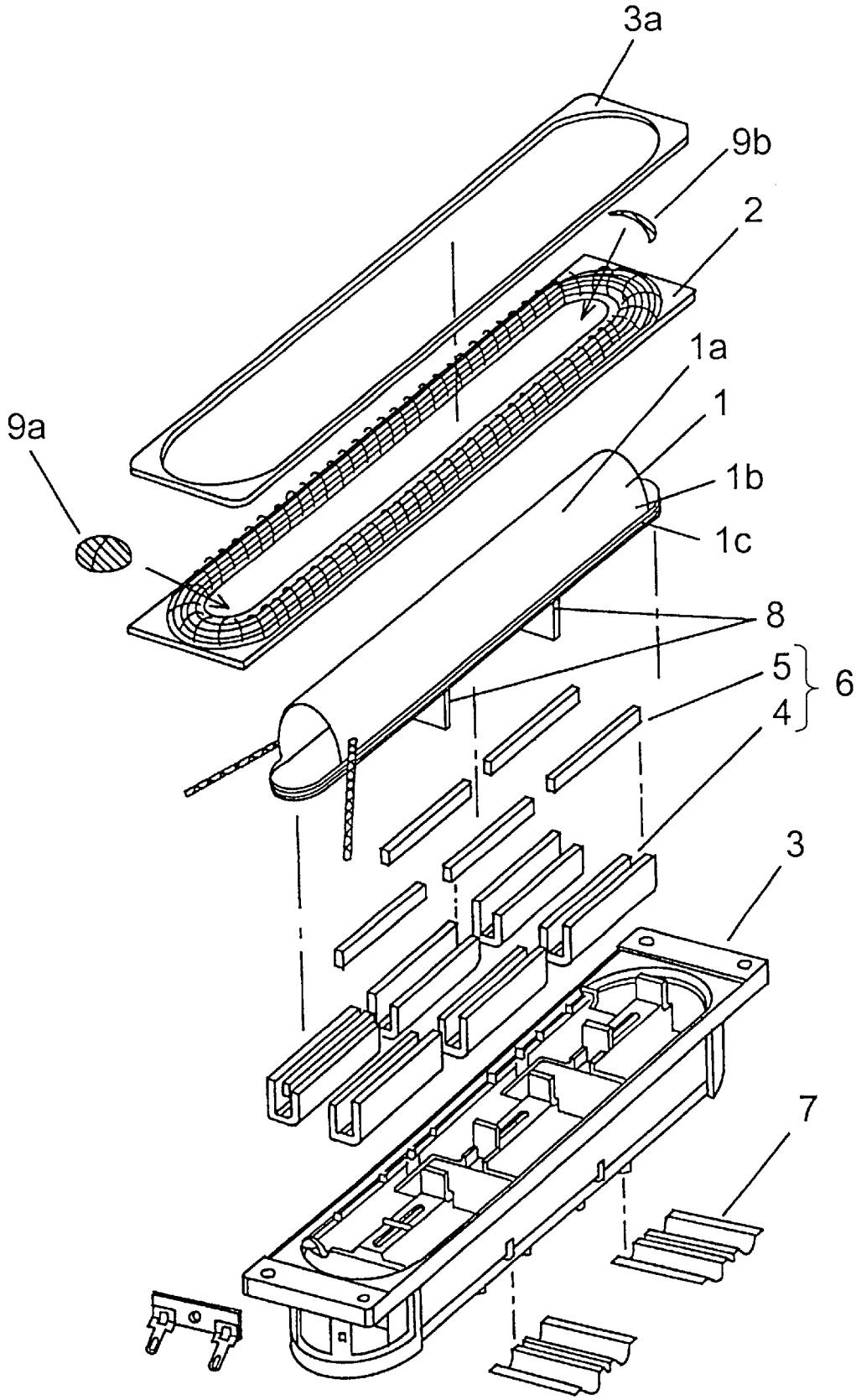
FIG. 6 Prior Art
FIG. 6 is an exploded perspective view of a conventional speaker.
Figure 7:
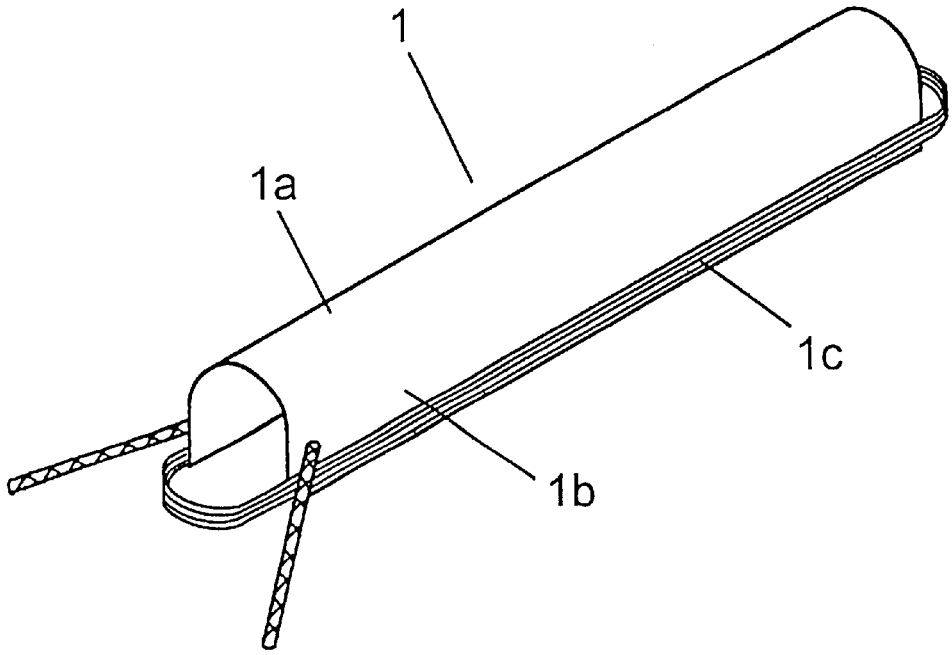
FIG. 7 Prior Art
FIG. 7 is a perspective view of an integral unit consisting of a voice coil bobbin unit and a diaphragm unit, the integral unit being a key portion of the conventional speaker.
Figure 8:
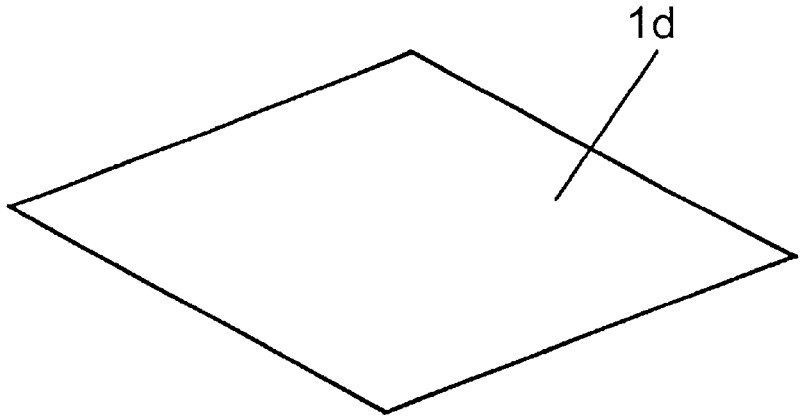
FIG. 8 Prior Art
FIG. 8 is a perspective view of the voice coil bobbin and the diaphragm of the conventional speaker, shown in the state of a sheet before it is fabricated.

A speaker in accordance with another exemplary embodiment of the present invention is described referring to FIG. 4 and FIG. 5.

Description is made here only on those points that are different from the speaker of the first embodiment. An edge 12 is provided with a supplement cover 12*a*, 12*b* of a spherical shape at both ends of the major axis. When the edge 12 is adhered at the inner circumference with the integral unit 11 consisting of a voice coil bobbin unit 11*b* and a diaphragm unit 11*a*, the supplement cover 12*a*, 12*b* is also adhered to the diaphragm unit 11*a* at both ends of the major axis to be integrated as the constituent functional part of the diaphragm unit 11*a*.

With the above described configuration, a process for adhering the supplement covers, which conventionally were independent components, is eliminated. This contributes to an improvement in productivity and reduce the assembly cost. The above described configuration is also advantageous for stabilizing the quality by avoiding possible troubles caused by separation of adhered components. Furthermore, a reduction in the overall weight of the adhesive agent used for adhering the supplement covers contributes to raising the sound pressure level. Esthetic quality level in terms of the product appearance is also improved.

INDUSTRIAL APPLICABILITY

As described in the foregoing, a speaker of the present invention comprises a magnetic circuit containing at least the magnetic gap, a frame connected to the magnetic circuit, and an integral unit consisting of a voice coil bobbin unit and a diaphragm unit connected at the periphery of the frame via an edge. The integral unit is formed of a ring shape voice coil bobbin unit which is wound around with coil to be coupled in the magnetic gap and a diaphragm unit formed in the shape of an inverse letter "U" disposed on the upper edge of the voice coil bobbin unit. With the above described configuration, since the voice coil bobbin unit has been provided in the form of a complete ring shape, the rigidity is enhanced. An irregular winding of coil on the voice coil bobbin is avoided, and the coil does not get loosened easily.

With the speaker of another example, in which the edge is integrally provided with supplement covers at the places corresponding to regions void of the diaphragm located at both ends of the major axis for coupling with the diaphragm unit, the supplement cover as an independent component can be eliminated. This contributes to reduction of the production/assembly cost. Furthermore, a reduction in the overall weight of a vibrating system improves the sound pressure level.

With the speaker of still another example, in which the integral unit consisting of a voice coil bobbin unit and a diaphragm unit is prepared out of a sheet which was provided through a punching of a sheet into the shape of a letter "H" having a pair of extensions from both sides, forming the sheet into the shape of an inverse letter "U", and joining the extensions together, it is easy to provide an integral unit that consists of a voice coil bobbin unit having a complete ring shape and a diaphragm unit through a substantially simple and easy operation. This contributes to a higher manufacturing productivity of the speakers.

What is claimed is:

1. A speaker comprising:

a magnetic circuit containing at least a magnetic gap;

a frame connected to said magnetic circuit; and an integral unit consisting of a voice coil bobbin unit and a diaphragm unit connected at a periphery of said frame via an edge, said integral unit being formed of said voice coil bobbin unit of a ring shape which is wound around with coil to be placed in said magnetic gap and said diaphragm unit formed in a shape of an inverse letter "U" disposed on an upper edge of said voice coil bobbin unit;

wherein said integral unit consisting of said voice coil bobbin unit and said diaphragm unit is prepared out of a sheet which was provided through a punching of a sheet into a shape of a letter "H" with a pair of extensions from both sides, forming the sheet into the shape of the inverse letter "U", and joining the extensions.

2. A speaker as claimed in claim 1, wherein:

the edge is integrally provided with a supplement cover corresponding to regions void of diaphragm at both ends of the major axis of said diaphragm unit for connection with said integral unit consisting of said voice coil bobbin unit and said diaphragm unit.

* * * * *